US008593448B2

(12) United States Patent
Park

(10) Patent No.: US 8,593,448 B2
(45) Date of Patent: Nov. 26, 2013

(54) ORGANIC LIGHT EMITTING DISPLAY AND METHOD OF DRIVING THE SAME

(75) Inventor: Sung-Cheon Park, Yongin (KR)

(73) Assignee: Samsung Display Co., Ltd., Yongin, Gyeonggi-Do (KR)

( * ) Notice: Subject to any disclaimer, the term of this patent is extended or adjusted under 35 U.S.C. 154(b) by 123 days.

(21) Appl. No.: 12/929,608

(22) Filed: Feb. 3, 2011

(65) Prior Publication Data

US 2011/0273427 A1 Nov. 10, 2011

(30) Foreign Application Priority Data

May 6, 2010 (KR) ..... 10-2010-0042418

(51) Int. Cl.
*G09G 5/00* (2006.01)
*G09G 3/30* (2006.01)

(52) U.S. Cl.
USPC ..... 345/212; 345/78

(58) Field of Classification Search
USPC ..... 345/76–86, 212
See application file for complete search history.

(56) References Cited

U.S. PATENT DOCUMENTS

| | | | | |
|---|---|---|---|---|
| 7,202,842 | B2 * | 4/2007 | Kasai et al. | 345/78 |
| 7,626,565 | B2 * | 12/2009 | Tsuge | 345/76 |
| 8,139,006 | B2 * | 3/2012 | Ryu et al. | 345/82 |
| 2005/0156837 | A1 * | 7/2005 | Kasai | 345/77 |
| 2005/0168490 | A1 * | 8/2005 | Takahara | 345/690 |
| 2007/0040770 | A1 * | 2/2007 | Kim | 345/76 |
| 2008/0088554 | A1 | 4/2008 | Lee | |
| 2008/0218448 | A1 * | 9/2008 | Park et al. | 345/76 |
| 2008/0246702 | A1 * | 10/2008 | Lee et al. | 345/77 |
| 2010/0097829 | A1 * | 4/2010 | Uno et al. | 363/124 |

FOREIGN PATENT DOCUMENTS

| | | | |
|---|---|---|---|
| JP | 2006-065148 | A | 3/2006 |
| KR | 10 2007-0074710 | A | 7/2007 |
| KR | 10 2008-0008070 | A | 1/2008 |
| KR | 10 2008-0034924 | A | 4/2008 |
| KR | 10 2008-0090879 | A | 10/2008 |
| KR | 10 2009-0131080 | A | 12/2009 |

OTHER PUBLICATIONS

Korean Office Action in KR 10-2010-0042418, dated Apr. 18, 2012 (Park).

* cited by examiner

*Primary Examiner* — Bipin Shalwala
*Assistant Examiner* — Michael J Jansen, II
(74) *Attorney, Agent, or Firm* — Lee & Morse, P.C.

(57) ABSTRACT

An organic light emitting display, and a method of driving the same, controls the voltage of a second power source in accordance with an ambient temperature. The organic light emitting display includes a driver IC configured to drive a pixel unit and to generate a control signal in accordance with an ambient temperature, and a DC-DC converter configured to generate a first power source and a second power source from an input voltage, to change a voltage of the second power source in accordance with the control signal from the driver IC, and to output the changed voltage of the second power source and the first power source.

18 Claims, 5 Drawing Sheets

RELATED ART

ORGANIC LIGHT EMITTING DISPLAY AND METHOD OF DRIVING THE SAME

BACKGROUND

1. Field

Embodiments relate to an organic light emitting display and a method of driving the same, and more particularly, to an organic light emitting display capable of controlling a voltage in accordance with a temperature change and a method of driving the same.

2. Description of the Related Art

Recently, various flat panel displays (FPD) capable of reducing weight and volume relative to cathode ray tubes (CRT) have been developed. The FPDs include a liquid crystal display (LCD), a field emission display (FED), a plasma display panel (PDP), and an organic light emitting display.

Among the FPDs, organic light emitting displays display an image using organic light emitting diodes (OLED) that generate light by re-combination of electrons and holes generated to correspond to the flow of current. Organic light emitting displays are widely used in numerous products, e.g., a personal digital assistant (PDA), an MP3 player, a mobile telephone, and so forth, due to various advantages, such as excellent color reproducibility and small thickness.

FIG. 1 illustrates a circuit diagram of a pixel adopted by a common organic light emitting display. Referring to FIG. 1, the pixel is coupled to a data line Dm and a scan line Sn, and includes a first transistor M1, a second transistor M2, a capacitor Cst, and an organic light emitting diode OLED.

The first transistor M1 has a source coupled to a first power source ELVDD, a drain coupled to an anode electrode of the OLED, and a gate coupled to a first node N1. The second transistor M2 has a source coupled to the data line Dm, a drain coupled to the first node N1, and a gate coupled to the scan line Sn. The capacitor Cst has a first electrode is coupled to the first power source ELVDD and a second electrode coupled to the first node N1. The OLED has an anode electrode coupled to the drain of the first transistor M1 and a cathode electrode coupled to a second power source ELVSS.

In the pixel having the above structure, the voltage of the first node N1 is determined to correspond to the data signal transmitted through the data line Dm. In accordance with the voltage of the first node N1, in the first transistor M1, current flows from the first power source ELVDD to the second power source ELVSS. Due to the above operation, the OLED emits light.

In the OLED adopted by the above pixel, current flows by the first power source ELVDD and the second power source ELVSS. The driving margin of the second power source ELVSS is determined in accordance with the current that flows at a low temperature.

However, organic light emitting displays are not always driven at the low temperature. When the voltage of the second power source ELVSS due to the driving margin set at the low temperature is used at a room temperature, the voltage of the second power source ELVSS is set to be lower than necessary, increasing power consumption.

SUMMARY

Embodiments are therefore directed to an organic light emitting display and a method of driving the same, which substantially overcome one or more of the problems due to the limitations and disadvantages of the related art.

It is therefore a feature of an embodiment to provide an organic light emitting display capable of controlling the voltage of a second power source in accordance with an ambient temperature change to improve efficiency and a method of driving the same.

It is therefore another feature of an embodiment to provide organic light emitting display and a method of driving the same, in which an increased margin of the voltage of the second power source is not needed.

It is yet another feature of an embodiment to provide organic light emitting display and a method of driving the same, in which the voltage of the second power source may be a low voltage.

It is still another feature of an embodiment to provide organic light emitting display and a method of driving the same, in which a control signal generated in accordance with the ambient temperature is input to an existing terminal, i.e., not requiring additional wiring.

At least one of the above and other features and advantages may be realized by providing an organic light emitting display, including a driver IC configured to drive a pixel unit and to generate a control signal in accordance with an ambient temperature, and a DC-DC converter configured to generate a first power source and a second power source from an input voltage, to output the first power source, to change a voltage of the second power source in accordance with the control signal from the driver IC, and to output the changed voltage of the second power source.

The driver IC may include a temperature sensor. The temperature sensor may include a sensing unit sensing an ambient temperature, a lookup table storing a number of pulses corresponding to a temperature sensed by the sensing unit, and a control signal output circuit configured to output the control signal having the number of pulses stored in the lookup table.

The driver IC may first drive the pixel unit with black data and then drive the pixel unit with image data.

The voltage of the second power source may change from a first voltage to a second voltage over a plurality of intervals. When the pixel unit is driven with black data, an interval may be larger than a predetermined voltage. When the pixel unit is driven with image data, an interval may be smaller than a predetermined voltage.

When the ambient temperature is higher than a predetermined temperature value, the voltage of the second power source may be set to be higher than a predetermined voltage value. When the ambient temperature is lower than the predetermined temperature value, the voltage of the second power source may be set to be lower than the predetermined voltage value.

The control signal may be input through an enable terminal of the DC-DC converter. The control signal may have a number of pulses in accordance with the ambient temperature.

A method of driving an organic light emitting display emitting light to correspond to current flowing from a first power source to a second power source, including measuring an ambient temperature, determining a control signal in accordance with the measured temperature, and changing a voltage of the second power source in accordance with the control signal.

The control signal may have a number of pulses in accordance with the ambient temperature. The number of pulses may be determined using a lookup table in which the number of pulses corresponding to the ambient temperature is stored.

The method may include inputting black data and then, inputting image data. The method may include changing the voltage of the second power source from a first voltage to a second voltage through a plurality of intervals. During inputting black data, an interval may be larger than a predetermined voltage. During inputting image data, an interval may be smaller than a predetermined voltage.

When the ambient temperature is higher than a predetermined temperature value, the voltage of the second power source may be set to be higher than a predetermined voltage value. When the ambient temperature is lower than the predetermined temperature value, the voltage of the second power source may be set to be lower than the predetermined voltage value.

BRIEF DESCRIPTION OF THE DRAWINGS

The above and other features and advantages will become more apparent to those of ordinary skill in the art by describing in detail exemplary embodiments with reference to the attached drawings, in which.

DETAILED DESCRIPTION

Korean Patent Application No. 10-2010-0042418, filed on May 6, 2010, in the Korean Intellectual Property Office, and entitled: "Organic Light Emitting Display and Driving Method Using the Same" is incorporated by reference herein in its entirety.

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey the scope of the invention to those skilled in the art.

Figure 1:
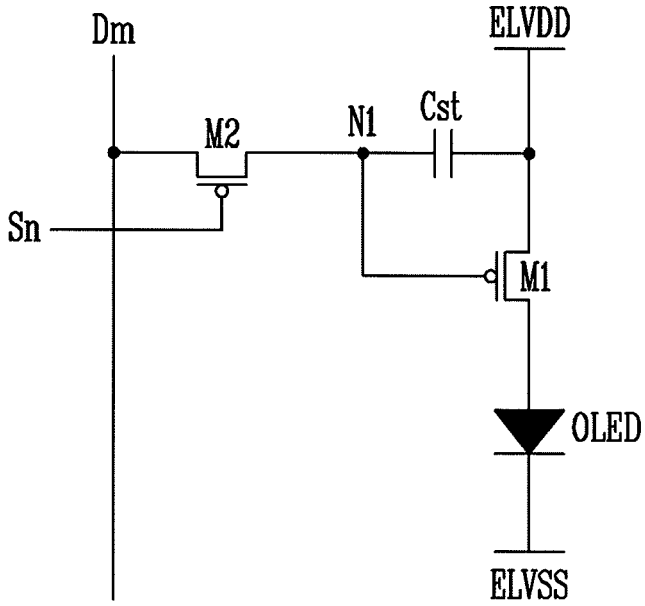
FIG. 1 illustrates a circuit diagram of a pixel adopted by a common organic light emitting display.
Figure 2:
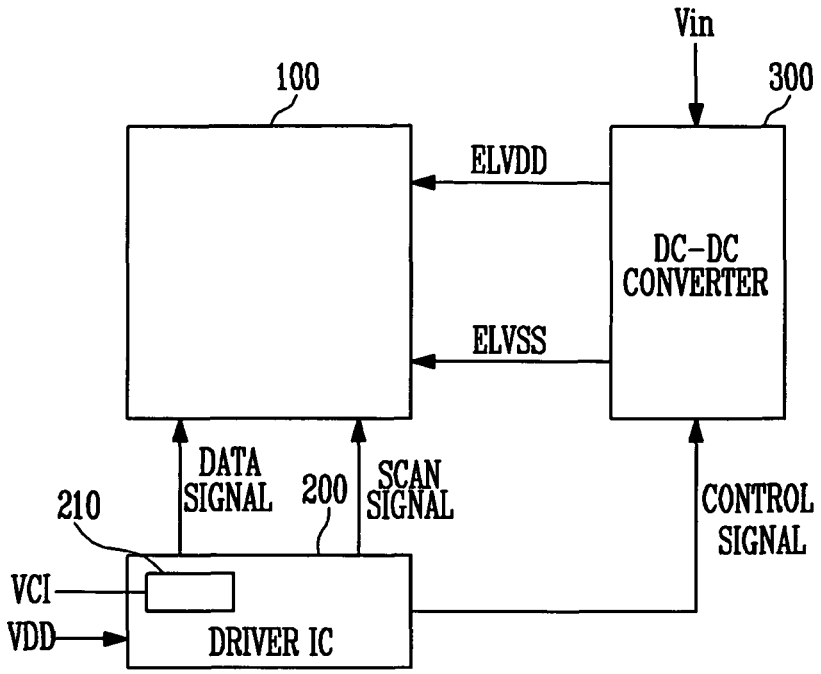
FIG. 2 illustrates a block diagram of an organic light emitting display according to an embodiment.

FIG. 2 illustrates a block diagram of an organic light emitting display according to an embodiment. Referring to FIG. 2, the organic light emitting display includes a pixel unit 100, a driver IC 200, and a DC-DC converter 300.

A plurality of pixels (not shown) is arranged in the pixel unit 100. Each pixel includes an organic light emitting diode (OLED) (not shown) that emits light in accordance with the flow of current. The pixel unit 100 also includes n scan lines (not shown) formed in a row direction and transmitting scan signals, and m data lines (not shown) formed in a column direction and transmitting data signals.

In addition, the pixel unit 100 receives a first power source ELVDD and a second power source ELVSS to be driven. Therefore, in the pixel unit 100, current flows to the OLED by the scan signals, the data signals, the first power source ELVDD, and the second power source ELVSS, so that the pixel unit 100 emits light to display an image.

The driver IC 200 drives the pixel unit 100 by transmitting data signals through the data lines and scan signals through the scan lines. In addition, the driver IC may also include a temperature sensor 210 to measure a ambient temperature, so that the voltage of the second power source ELVSS output by the DC-DC converter 300 may be changed in accordance with the ambient temperature. In particular, the driver IC 200 generates a control signal based on the ambient temperature detected by the temperature sensor 200. The control signal controls the DC-DC converter 300 to change the voltage of the second power source ELVSS in accordance with the ambient temperature. In detail, a number of pulses of the control signal may be determined to correspond to the ambient temperature measured by the temperature sensor 210. In other words, the number of pulses of the control signal is controlled in accordance with the ambient temperature change.

In addition, the driver IC 200 receives a first driving power source VDD to be driven. The temperature sensor 210 included in the driver IC 200 receives a second driving power source VCI to be driven.

The DC-DC converter 300 receives an input voltage Vin from the outside and generates the first power source ELVDD and the second power source ELVSS. The DC-DC converter 300 includes a booster circuit that boosts the input voltage to generate the first power source ELVDD and an inverter circuit that inverts the input voltage to generate the second power source ELVSS.

The control signal output from the driver IC 200 is input to an enable terminal of the DC-DC converter 300. The DC-DC converter 300 determines the magnitude of the voltage of the second power source ELVSS in accordance with the number of pulses of the control signal transmitted by the driver IC 200.

Figure 3:
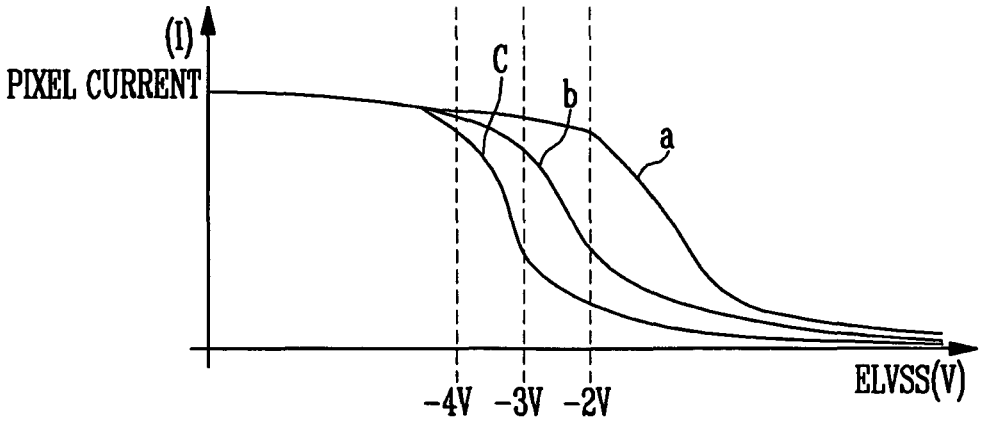
FIG. 3 illustrates a graph of a voltage of a second power source in accordance with a change in a temperature and a change in the amount of current that flows through a pixel.

FIG. 3 illustrates a graph of the voltage of a second power source in accordance with a change in a temperature and a change in the amount of current that flows through a pixel. Referring to FIG. 3, "a" illustrates a change in the voltage of the second power source at a high temperature, i.e., higher than room temperature, and the amount of current that flows to the pixel; "b" illustrates a change in the voltage of the second power source at a room temperature and the amount of current that flows to the pixel; and "c" illustrates a change in the voltage of the second power source at a low temperature, i.e., lower than room temperature, and the amount of current that flows through the pixel.

As can be seen in FIG. 3, as a temperature decreases, the voltage at which the second power source ELVSS, providing current to the pixel, reaches a saturation region decreases. Therefore, since the voltage of the saturation region at the room temperature or at the high temperature is higher than at the low temperature, it is not necessary to increase the voltage of the second power source ELVSS. Thus, the level of the input voltage Vin at the room temperature or at the high temperature may be decreased.

However, when the organic light emitting display is designed, in order to have a desired image displayed sufficiently under bad conditions, the voltage of the second power source ELVSS is designed to have the margin of the voltage level of about 2 or 3V. Therefore, when the voltage of the second power source ELVSS is fixed during the designing of the organic light emitting display, in which low temperature is assumed, the second power source ELVSS is fixed at a higher level than needed for most operations. That is, the absolute value of the voltage level of the second power source ELVSS is fixed to be large. However, in accordance with embodiments, when the voltage level of the second power source ELVSS is controlled in accordance with the ambient temperature, since the voltage level of the second power source ELVSS output from the DC-DC converter 300 is not always set as a voltage suitable for low temperature operation, the efficiency of the DC-DC converter 300 is improved.

Figure 4:
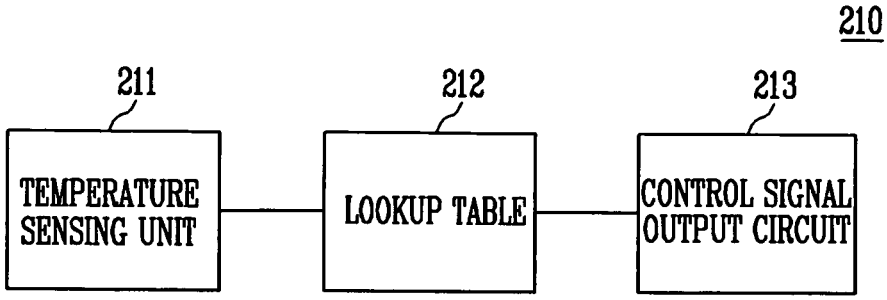
FIG. 4 illustrates a block diagram of a temperature sensor adopted by the organic light emitting display of FIG. 2 according to an embodiment.

FIG. 4 illustrates a block diagram of the temperature sensor 210 adopted by the organic light emitting display of FIG. 2 in accordance with an embodiment. Referring to FIG. 4, the temperature sensor 210 includes a temperature sensing unit 211, a lookup table 212, and a control signal output circuit 213.

The temperature sensing unit 211 measures the ambient temperature and generates a temperature signal using the measured temperature.

The lookup table 212 stores the voltage of the second power source ELVSS and the digital value corresponding to the temperature of a panel, for example, as illustrated in the following TABLE 1. Then, the number of pulses of the control signal is determined using the digital value.

TABLE 1

| States | Panel temperature (° C.) | Voltage of second power source | Digital value |
|---|---|---|---|
| 01 | 10 < panel temperature < 30 | −2.5 V | 11110 |
| 02 | 0 < panel temperature < 10 | −2.6 V | 11101 |
| 03 | −10 < panel temperature < 0 | −3.1 V | 11000 |
| 04 | −20 < panel temperature < −10 | −3.9 V | 10000 |

In the lookup table 212, values of the voltage of the second power source are stored in accordance with the ambient temperature. The voltage of the second power source output by the lookup table 212 changes only when the ambient temperature is less than a set value. Then, the voltage of the second power source output by the lookup table 212 changes when a change in ambient temperature exceeds a set value. For example, the voltage of the second power source may be changed only once the ambient temperature is less than 10° C. Then, the voltage of the second power source may be changed as the ambient temperature decreases by more than a set amount, e.g., 10° C.

The control signal output circuit 213 generates the control signal having the number of pulses stored in the lookup table 212.

Figure 5:
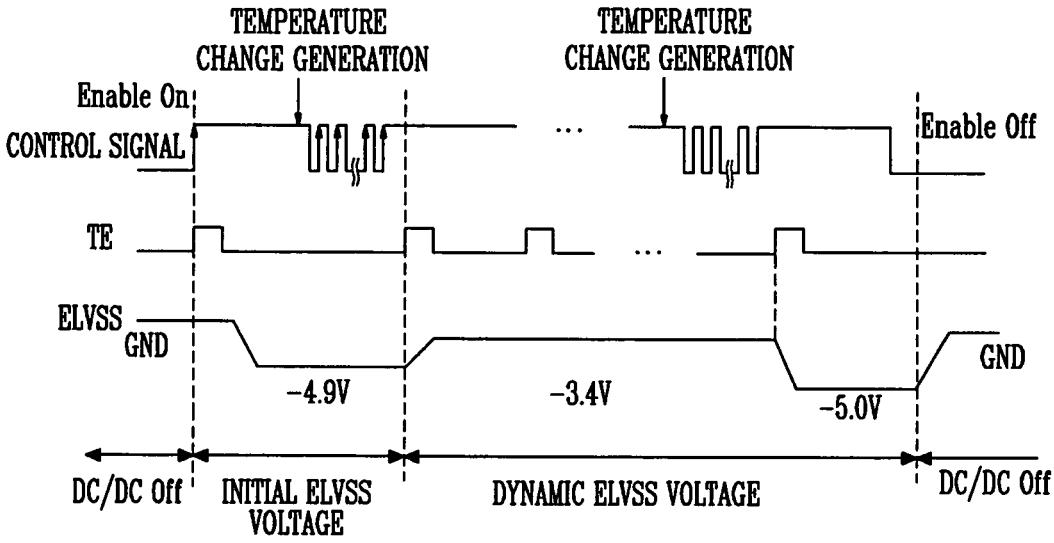
FIG. 5 illustrates a timing diagram of operation of a DC-DC converter adopted by the organic light emitting display of FIG. 2 according to an embodiment.

FIG. 5 illustrates a timing diagram of the operation of a DC-DC converter adopted by the organic light emitting display of FIG. 2 according to an embodiment. Referring to FIG. 5, the DC-DC converter 300 starts driving when the control signal input to the enable terminal is at a high level. At this time, the inverting circuit operates to generate the second power source ELVSS. The voltage of the second power source ELVSS is set as an initial value, e.g., −4.9 V. This initial value may correspond to a value for black data. In addition, a synchronization signal TE may be transmitted every frame.

When the temperature is initially sensed and image data is supplied, the control signal has the number of pulses in accordance with the sensed temperature. For example, the voltage of the second power source ELVSS may change to −3.4V after the initial period. Then, when a temperature change is sensed, the control signal changes the number of pulses suitable in accordance with the sensed temperature. For example, the voltage of the second power source ELVSS may change to −5.0 V.

When the organic light emitting display stops driving, a low signal is input to the enable terminal of the DC-DC converter 300 so that the DC-DC converter 300 stops. At this time, when the enable terminal receives a signal at a low level for no less than a set time, in order to distinguish the low level caused by the pulse waveform of the control signal for indicating temperature from the low level of the control signal for stopping driving, it is determined that the organic light emitting display is stopped.

Figure 6A:
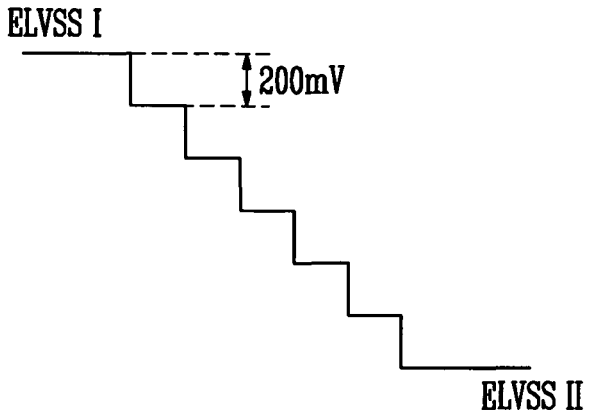
FIG. 6A illustrates a first embodiment for changing the voltage of the second power source from a first voltage to a second voltage.
Figure 6B:
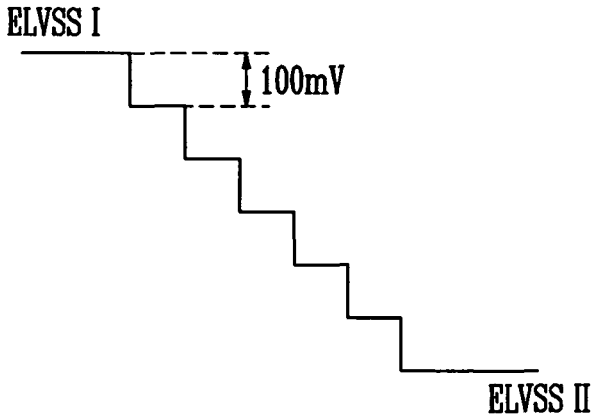
FIG. 6B illustrates a second embodiment for changing the voltage of the second power source from the first voltage to the second voltage.

FIG. 6A illustrates a first embodiment for changing the voltage of the second power source from a first voltage to a second voltage. FIG. 6B illustrates a second embodiment for changing the voltage of the second power source changes from the first voltage to the second voltage. Referring to FIGS. 6A and 6B, the voltage of the second power source changes from the first voltage ELVSS I to the second voltage ELVSS II over a plurality of intervals. These intervals may be evenly spaced. In FIG. 6A, the intervals have a voltage difference of 200 mV there between. In FIG. 6B, the intervals have a voltage difference of 100 mV there between.

When the interval is 200 mV (no less than 100 mV) as illustrated in FIG. 6A, when the voltage of the second power source changes from the first voltage ELVSS I to the second voltage ELVSS II, the second power source ELVSS changes from the first voltage ELVSS I to the second voltage ELVSS II when black data is input to the pixel unit 100. When the interval 100 mV (no more than 100 mV) as illustrated in FIG. 6B, when the voltage of the second power source changes from the first voltage ELVSS I to the second voltage ELVSS II, since picture quality does not significantly deteriorate, the voltage change point of time of the second power source ELVSS does not need to be specified. In other words, when black data is input, the change in the voltage of the second power source may be faster than when image data is input.

Figure 7:
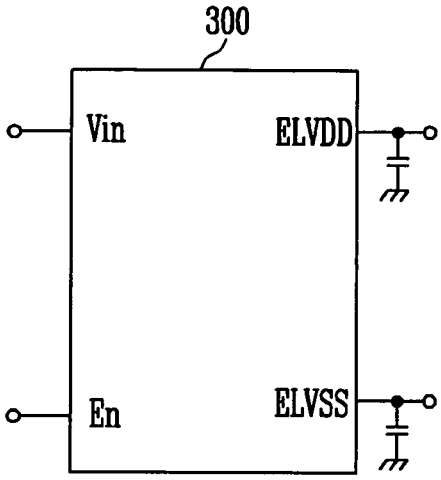
FIG. 7 illustrates a block diagram of a DC-DC converter adopted by the organic light emitting display of FIG. 2.

FIG. 7 illustrates a block diagram of an embodiment of the DC-DC converter 300 adopted by the organic light emitting display of FIG. 2 according to an embodiment. Referring to FIG. 7, the DC-DC converter 300 generates the first power source ELVDD and the second power source ELVSS using the input voltage Vin. Whether the DC-DC converter is to be driven is determined by a signal input through the enable terminal EN. The control signal output from the driver IC 200 is also input to the enable terminal EN of the DC-DC converter 300. Therefore, since an additional terminal for inputting the control signal controlling the second power source ELVSS in accordance with the temperature change is not required, an additional wiring line is not required.

Exemplary embodiments have been disclosed herein, and although specific terms are employed, they are used and are to be interpreted in a generic and descriptive sense only and not for purpose of limitation. Accordingly, it will be understood by those of ordinary skill in the art that various changes in form and details may be made without departing from the spirit and scope of the present invention as set forth in the following claims.

What is claimed is:

1. An organic light emitting display, comprising:

a driver IC configured to drive a pixel unit and to generate a control signal in accordance with an ambient temperature; and a DC-DC converter configured to generate a first power source and a second power source from an input voltage, wherein the DC-DC converter includes a booster circuit that boosts the input voltage to generate the first power source and an inverter circuit that inverts the input voltage to generate the second power source, wherein the control signal from the driver IC is input to an enable terminal of the DC-DC converter, a magnitude of a voltage of the second power source being determined in accordance with the control signal, wherein the second power source changes from a first voltage to a second voltage over a plurality of evenly spaced step intervals when black data and image data is input, and wherein a voltage change from the first voltage to the second voltage has a smaller voltage difference at each step interval during a period of black data input than during a period of image data input.

2. The organic light emitting display as claimed in claim 1, wherein the driver IC further comprises a temperature sensor.

3. The organic light emitting display as claimed in claim 2, wherein the temperature sensor includes:

a sensing unit sensing the ambient temperature;

a lookup table storing a number of pulses corresponding to a temperature sensed by the sensing unit; and a control signal output circuit configured to output the control signal having the number of pulses stored in the lookup table.

4. The organic light emitting display as claimed in claim 1, wherein the driver IC first drives the pixel unit with black data and then drives the pixel unit with image data.

5. The organic light emitting display as claimed in claim 1, wherein, when the pixel unit is driven with black data, each discrete interval is larger than a predetermined voltage.

6. The organic light emitting display as claimed in claim 1, wherein, when the pixel unit is driven with image data, each discrete interval is smaller than a predetermined voltage.

7. The organic light emitting display as claimed in claim 1, wherein:

when the ambient temperature is higher than a predetermined temperature value, the voltage of the second power source is set to be higher than a predetermined voltage value, and when the ambient temperature is lower than the predetermined temperature value, the voltage of the second power source is set to be lower than the predetermined voltage value.

8. The organic light emitting display as claimed in claim 1, wherein the control signal has a number of pulses in accordance with the ambient temperature.

9. The organic light emitting display as claimed in claim 6, wherein, when the pixel unit is driven with black data, each discrete interval is larger than the predetermined voltage.

10. A method of driving an organic light emitting display emitting light to correspond to current flowing from a first power source to a second power source, comprising:

measuring an ambient temperature;

determining a control signal in accordance with the measured temperature;

changing a voltage of the second power source in accordance with the control signal; and changing the voltage of the second power source from a first voltage to a second voltage over a plurality of evenly spaced step intervals when black data and image data is input, wherein a voltage change from the first voltage to the second voltage has a smaller voltage difference at each step interval during a period of black data input than during a period of image data input.

11. The method as claimed in claim 10, further comprising:

boosting an input voltage to generate a first power source; and inverting the input voltage to generate the second power source.

12. The method as claimed in claim 10, wherein the control signal has a number of pulses in accordance with the ambient temperature.

13. The method as claimed in claim 12, further comprising determining the number of pulses using a lookup table in which the number of pulses corresponding to the ambient temperature is stored.

14. The method as claimed in claim 10, further comprising:

inputting black data; and then, inputting image data.

15. The method as claimed in claim 10, wherein, during inputting black data, each discrete interval is larger than a predetermined voltage.

16. The method as claimed in claim 10, wherein, during inputting image data, each discrete interval is smaller than a predetermined voltage.

17. The method as claimed in claim 10, further comprising:

when the ambient temperature is higher than a predetermined temperature value, setting the voltage of the second power source to be higher than a predetermined voltage value; and when the ambient temperature is lower than the predetermined temperature value, setting the voltage of the second power source to be lower than the predetermined voltage value.

18. The method as claimed in claim 16, wherein, during inputting black data, each discrete interval is larger than the predetermined voltage.

* * * * *